US007003939B1

(12) United States Patent
Rackwitz et al.

(10) Patent No.: US 7,003,939 B1
(45) Date of Patent: Feb. 28, 2006

(54) METHOD FOR THE ADAPTION OF THE OPERATION OF A STAGED COMBUSTION CHAMBER FOR GAS TURBINES

(75) Inventors: Leif Rackwitz, Berlin (DE); Klaus-Jurgen Schmidt, Berlin (DE)

(73) Assignee: Rolls-Royce Deutschland Ltd & Co KG, Blankenfelde-Mahlow (DE)

( * ) Notice: Subject to any disclaimer, the term of this patent is extended or adjusted under 35 U.S.C. 154(b) by 0 days.

(21) Appl. No.: 09/642,096

(22) Filed: Aug. 21, 2000

(30) Foreign Application Priority Data

Aug. 21, 1999 (DE) ..... 199 39 812
Jul. 4, 2000 (DE) ..... 100 32 471

(51) Int. Cl.
*F02C 7/22* (2006.01)

(52) U.S. Cl. ..... 60/39.141; 60/734; 60/746

(58) Field of Classification Search ..... 60/39.141, 60/734, 739, 746, 747, 790
See application file for complete search history.

(56) References Cited

U.S. PATENT DOCUMENTS 4,735,052 A * 4/1988 Maeda et al. ..... 60/733
4,920,740 A * 5/1990 Shekleton ..... 60/739
5,261,222 A * 11/1993 Napoli ..... 60/39.141
5,361,576 A 11/1994 Müller
5,402,634 A 4/1995 Marshall
5,406,798 A * 4/1995 Wiesner ..... 60/734
5,634,328 A 6/1997 Ansart et al.
5,795,998 A * 8/1998 Smith ..... 73/118.1
5,878,566 A 3/1999 Endo et al.
5,881,550 A * 3/1999 Toelle ..... 60/739

FOREIGN PATENT DOCUMENTS

DE 19518634 10/1995

(Continued)

OTHER PUBLICATIONS

Ishikawa et al., NOx Combustor for Gas Turbine, Patent Absracts of Japan, ©1999, p. 1.

*Primary Examiner*—Louis J. Casaregola
(74) *Attorney, Agent, or Firm*—Harbin King & Klima

(57) ABSTRACT

This invention relates to a fuel injection system for a staged combustion chamber (1) of a gas turbine aero-engine, in which a certain quantity of fuel is permanently supplied to the pilot burner(s) (3) and in which fuel is apportioned to the main burner(s) (4) only at higher engine performance, whereby a staging valve unit (7) which variably splits the total fuel mass flow (WF) to the pilot burners (3) and to the main burners (4) is provided downstream of a control valve unit (6) which controls the entire fuel mass flow, with both valve units being actuated by an engine control unit (8) and with the actuation of the staging valve unit (7) being accomplished on the basis of the desired engine performance, characterized in that the engine performance is described by way of a staging parameter (SP) reflecting the load of the gas turbine combustion chamber (1) and actuating the staging control unit (7) according to a switching line, in that the staging parameter (SP) is derived from a functional relationship, in that a downstream summation point is provided for the computation of the difference between an actual value of the staging point and a value of the nominal staging point, and in that a time element (TIMER) is provided subsequent to the summation point, said time element being designed such that switch-over is delayed upon overshooting or undershooting of the adjusted staging point, respectively, if the period since the execution of the previous staging event is smaller than a pre-defined time constant held in a family of characteristics.

21 Claims, 3 Drawing Sheets

FOREIGN PATENT DOCUMENTS

Figure 1:
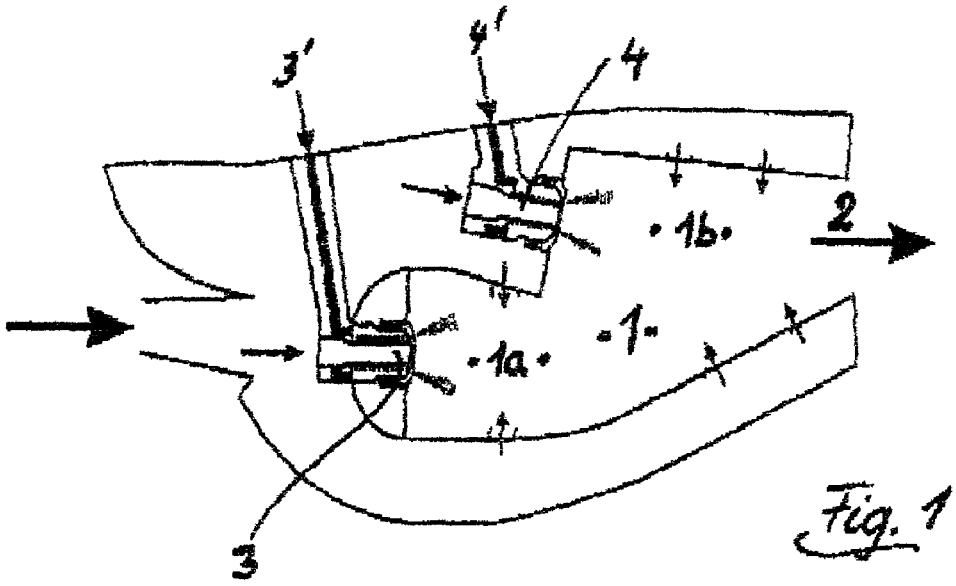

| | | |
|---|---|---|
| DE | 19728375 | 1/1999 |
| EP | 527629 | 2/1993 |
| EP | 718559 | 6/1996 |
| EP | 905448 | 3/1999 |
| EP | 905449 | 3/1999 |
| WO | 95/17632 | 6/1995 |

* cited by examiner

METHOD FOR THE ADAPTION OF THE OPERATION OF A STAGED COMBUSTION CHAMBER FOR GAS TURBINES

This invention relates to a fuel injection system for a staged combustion chamber, for example of an aircraft gas turbine engine or a stationary gas turbine, whose pilot burner(s) is (are) continuously supplied with a certain quantity of fuel and whose main burner(s) is (are) apportioned with fuel only at higher engine performance levels, whereby a staging valve unit is provided downstream of a control valve unit which serves for the control of the entire fuel quantity, with the staging valve unit variably apportioning this total fuel mass flow to the pilot burner(s) and to the main burner(s) and with both the staging valve unit and the control valve unit being controlled by an engine control unit which actuates the staging valve unit on the basis of the desired engine performance level. Such a fuel injection system is taught in Specification WO 95117632.

With a staged combustion chamber, the pollutant emission of a gas turbine, in particular of an aircraft gas turbine engine, can be reduced if the fuel injection into the combustion chamber is designed appropriately to this purpose. In particular, the said staging valve unit must be controlled in a suitable manner, i.e. the apportionment of the entire fuel metered to the pilot zone of the combustion chamber in a certain operating point, which is associated with the pilot burner or, in most cases, with several pilot burners, and to the main zone of the combustion chamber, which is associated with the main burner or, in most cases, with several main burners, should be accomplished by way of characteristics which are preferably designed for low pollutant emission of the combustion chamber or of the combustion process taking place therein, respectively. Of course, other criteria may also be considered in the design of these characteristics, for example a maximum stability margin against flame-out. In this context, it should be noted that the said apportionment of the total fuel mass flow to the pilot zone and to the main zone of the combustion chamber also comprises that state in which the entire fuel quantity is solely supplied to the pilot burner(s).

In the aforementioned Specification WO 95117632, reference is made to a thrust-indicative parameter according to which the apportionment of the total fuel mass flow is accomplished, i.e. this thrust-indicative parameter is used as an input for the control of the staging valve unit which apportions the entire fuel quantity as it is metered by a control valve unit between the pilot burners and the main burners. The thrust-indicative parameter according to the above Specification, which generally is termed and referred to as staging parameter, is a characteristic of the desired engine performance producible with the metered total fuel mass flow. For this staging parameter, which obviously should be easily recordable or measurable, either the gas temperature at the compressor exit or the quotient of the total fuel mass flow and the pressure in the combustion chamber is proposed in the referred Specification.

As already mentioned in the above, the staging valve unit is to be controlled or actuated, respectively, by recourse to emission-optimized characteristics, i.e. the staging parameter by way of which the staging valve unit (because of the recourse to the said characteristics) is controlled according to a switching line should not only be related to the performance of the engine but also be connected with the operation of the combustion chamber in order to effectively utilize the inherent advantages of a staged combustion chamber in terms of the reduction of the pollutant emission.

As regards the control of a gas turbine aero-engine with a low-emission, staged combustion chamber, permanent switching between pilot and two-stage operation during low speed or load oscillations is to be avoided. This would affect both the stability of the engine and the life of hot-section parts. A switching hysteresis with an appropriately wide hysteresis band will preclude undesired cycling of the fuel staging process.

Generally, such hysteresis methods are frequently used for control purposes. By the definition of an upper and a lower staging point, a switch-back to pilot operation, for example, will only be accomplished if the lower staging point is undershot, i.e. an accordingly large load change of the engine has taken place. Such a method is taught in Specification WO 95117632.

The application of a switching hysteresis entails the following disadvantages: The permanent calculation of two staging points (upper and lower) requires a higher investment in software than a single staging point. Furthermore, the use of a hysteresis band in the staging circuitry calls for a greater compromise in terms of the optimization for low pollutant in the staging area than a single staging point. In practice, due to signal noise, the width of the hysteresis band will also be embarrassed by the quality of the staging parameter. This will have adverse effects on the pollutant emission or it will require the use of expensive measuring equipment and technology, respectively. If a switching hysteresis is used, its band width must be flexible and it shall be governed by the transient state of the engine. This constraint also imposes arduous requirements on the measuring signal.

In a broad aspect, the present invention provides a fuel injection system in accordance with the generic part of Claim 1 which enables the operation of the combustion chamber of the gas turbine aero-engine to be improved in particular with regard to low pollutant emission.

It is the principal object of the present invention to provide remedy to the above problematics by the combination of the features expressed in the main claim, with further advantageous aspects of the present invention being cited in the subclaims.

The present invention is characterized by a variety of merits.

The present invention provides a control concept for the safe and loss-minimizing operation of a staged combustion chamber of an aero-engine. The control system according to the present invention enables the staged combustion chamber to be operated in two different operation modes. In the lower load range, the entire fuel is injected into the pilot zone of the combustion chamber. In this mode, the operation of a staged combustion chamber corresponds to that of a non-staged combustion chamber. In addition, in non-staged operation, the main burners are cooled with fuel from the pilot circuit to reduce the hazard of coking. At a given operating point, the main stage is switched on in a defined manner so that both manifolds (pilot stage and main stage) are supplied with fuel. Fuel apportioning is accomplished by an additional metering valve which distributes the total fuel between the pilot circuit and the main circuit. This operating state of the combustion chamber is termed the staged mode.

An essential feature of the new method is the time element "TIMER". Accordingly, the upstream logic for the calculation of a nominal staging point enables various influences, such as transient operation and flight altitude, to be considered via a summation point. If the difference between the new, adapted switching point and the actually measured value is smaller than a limit, the staged mode will be selected (command for staging point, SPK=1). After the nominal staging point has been overshot or undershot, respectively, the switching event will be time-delayed if the period since the execution of the last staging event is smaller than a pre-defined time constant stored in a family of characteristics.

As soon as SPK assumes the value 1, the time element "TIMER" will be activated. The function "TIMER" uses the actual, current value of SPK as an input. The parameter $t_{MIN,\ staging}$ serves for the control of the element "TIMER" and describes the minimum period to be maintained between two staging events if a switch-over between the two operating conditions is to be made. If the command for a further staging event is within the time window, the output of the time element (time-delayed command for staging point, SPK*) will be held at the value of the input (=SPK) until the actual time period since the last staging event is larger than the minimum staging interval, i.e. $t_{TIMER}>t_{MIN,staging}$.

The family of characteristics for the minimum staging cycle $t_{MIN,staging}$ takes account of the influence of rapid load changes of the aero-engine. In rapid load changes, which call for immediate system response of the engine, for example during go-around, the requirement for the maintenance of a minimum staging cycle is secondary, so that the value of $t_{MIN,staging}$ is equal to 0. The slower the load change, the larger the value of $t_{MIN,staging}$ with the maximum value, which is infinitive ($t_{MIN,staging}$ >>1 sec), being achieved in the case of quasi-stationary load changes. In this case, in which no load change takes place or no alteration of the power level position is made, respectively, the operating state of the combustion chamber is "frozen", i.e. the operating state is not changed and the combustion chamber remains in the previous operating mode (either non-staged or staged). The operating condition of the combustion chamber will only be changed, and a finite minimum staging cycle ($t_{MIN,staging}$<1 sec) be re-selected, when a load change is identified from an alteration of speed (IdNH/dtl>0). The output SPK* of the "TIMER" function serves as control variable for a subsequent selector element. If the value of SPK* is 0, "F" (=false) will be selected on the selector element. In this state, the calculated operating stage (BZ) of the staged combustion chamber is equal to SPK, i.e. the actual value of the staging point calculation is used for the selection of the operating mode. However, as soon as the value of SPK* is 1, i.e. a staging event is to take place within $t_{MIN,staging}$, the historical value of BZ (selector element "T" (=true)), i.e. the value from the last time step $Z^{-1}$, will be used. This avoids cyclic switching of the staging valve between the two operating modes. If the time criterion for the minimum staging cycle is transgressed, the operating state (0=non-staged, 1=staged) will be controlled again to the computing procedure according to the present invention.

Accordingly, the present invention provides for a high degree of flexibility in the control of the operating state of a staged combustion chamber, with the stable operation of the combustion chamber in non-staged and staged condition being ensured by the introduction of a variable time function. An increased signal noise of the control parameters, for example of P30, does not affect the selection of the operating mode in steady-state operation of the aero-engine since switch-over is not possible in this event. A further switching event will only be released upon a load change detected by a change of the high-pressure speed ((IdNH/dtl>0).

The present invention further provides that the engine performance is characterized in the form of a staging parameter (SP) reflecting the combustion chamber load, with the said staging parameter (SP) being used to control the staging valve unit according to a switching line and being derived from one of the following relationships:

According to the first functional relationship, the total fuel mass flow (WF) is divided by the gas pressure at the combustion chamber entry (P30) and the resultant quotient is multiplied with the gas temperature at the combustion chamber entry (T30), i.e. the staging parameter SP is a function of [WF/P30·T30].

According to the second functional relationship, the total fuel mass flow (WF) is divided by the gas pressure at the combustion chamber entry (P30) and the resultant quotient is multiplied by the square root of the gas temperature at the combustion chamber entry (T30), i.e. the staging parameter SP is a function of [WF/P30·(T30)$^{1/2}$].

According to the third functional relationship, the total fuel mass flow (WF) is divided by the gas pressure at the combustion chamber entry (P30) and the resultant quotient is multiplied by the square root of the quotient of the gas temperature at the combustion chamber entry (T30) and the gas temperature at the engine inlet (T20), i.e. the staging parameter SP is a function of [WF/P30·(T30/T20)$^{1/2}$].

According to the fourth functional relationship, the total fuel mass flow (WF) is divided by the gas pressure at the combustion chamber entry (P30) and the resultant quotient is multiplied by the value of the quantity of the total temperature downstream of the high-pressure turbine (=T44) or with the square root thereof, i.e. the staging parameter SP is a function of [WF/P30·T44] or [WF/P30·(T44)$^{1/2}$], respectively.

In other words, the fuel injection system of a staged gas turbine combustion chamber is to be controlled by a staging parameter characterizing the load of this combustion chamber, with the said staging valve unit being actuated according to a switching line and with the staging parameter being derived from one of the aforementioned relationships.

According to the present invention, the said staging parameter (SP) is not so much a thrust-indicative parameter as a parameter which reflects the combustion chamber load, which enables the families of characteristics which are accessed via this staging parameter and from which the staging valve unit is controlled according to a switching line to be designed with distinctly stronger consideration of the combustion chamber and, accordingly, the combustion process taking place therein. This provides for improved combustion in almost all operating states of the combustion chamber in which a staged combustion takes place, i.e. in which both the pilot burners and the main burners are supplied with fuel.

In this context, it should be noted that the total fuel mass flow (WF) can be calculated from a special calibration table in dependence of the valve position of the control valve unit already mentioned at the beginning, said control valve unit establishing this total fuel mass flow by way of a primary metering valve. Also, the signal representing this total fuel mass flow, which may be particularly susceptible to signal noise, can be filtered with suitable low-pass elements. In addition, the requirements on the fuel-to-air ratio desired in the individual operating points (in particular also with regard to the flame-out limits) can be represented in appropriate families of characteristics via functional relationships.

As already explained, the control system according to the present invention provides for operation of a staged combustion chamber in two different operating modes. In the lower load range of the engine, the entire amount of fuel is injected into the pilot zone of the combustion chamber, i.e. the operation of the staged combustion chamber in this mode corresponds to the operation of a non-staged combustion chamber. At a given operating point, the main stage is added in a defined manner, whereupon both the pilot burners and the main burners are supplied with fuel. The switch-over between the non-staged and the staged operating mode is accomplished by inclusion of the time element (TIMER) according to the present invention, whereby the main burners are switched in when engine performance exceeds the staging point and are switched off when engine performance falls below the staging point.

In a quasi-stationary operating state of the engine, the staging point is preferably determined from a family of characteristics in dependence of the staging parameter according to the present invention. Since it is desired that the switch-over always takes places at the same value of the fuel-to-air ratio, a variety of influences is to be considered according to a favorable development of the present invention. The staging point is obtained from the addition or subtraction, respectively, of correction elements (ΔSP) to or from the nominal staging parameter (SP) derived from one of the functional relationships specified further above. It should be noted that a separate additive correction element can be provided for each influencing parameter and that all these additive correction elements can then be summed up, i.e. practically all significant influencing parameters can be included in the calculation of the staging point. Here, the individual input of the influencing parameters is considered as relative change of the nominal staging point.

A first such influencing parameter is the absolute value of the gas pressure (P30) and/or the gas temperature (T30) at the combustion chamber entry. Regarding these functions, it is proposed to delay the switching process from the non-staged to the staged mode when the combustion chamber entry pressure (P30) and/or the combustion chamber entry temperature (T30) fall/falls below certain limits for the stable operation of the combustion chamber as established by combustion chamber testing. In particular, this function is active in the staged mode and effects a switch-over to the pilot mode when the said limits for (P30) and/or (T30) are undershot, in which mode only the pilot burners are supplied with fuel.

A second influencing parameter is the corrected speed of the high-pressure compressor (N2RT20) and the gas pressure at the engine inlet (P20). These functions, which are redundant as well, can be applied to avoid switch-over from the non-staged to the staged mode below the idle operating condition of the engine. Actually, it is proposed to shift the staging point artificially to very high values of the staging parameter (SP) in dependence of defined limits for the corrected high-pressure compressor speed (N2RT20) and for the fan inlet pressure (P20), thereby delaying switch-over until these limits are exceeded.

A third influencing parameter is the flight altitude of the gas turbine aero-engine and changes of the ambient conditions.

Finally, a fourth influencing parameter is the load change rate of the engine for which the following applies: In the staged mode, the stability of combustion in the pilot zone is crucial for the safe operation of the combustion chamber. In order to avoid flameout of the pilot burners by adverse apportionment of fuel to the two fuel circuits, i.e. to the pilot burners and to the main burners, in any operating state, the switch-over process from pure pilot operation to staged operation is delayed in the event of rapid transient load changes. For this purpose, an offset which is dependent of the operating state of the combustion chamber is added to the aforementioned basic value of the staging point. Accordingly, in the case of rapid load changes, the staging point will be shifted towards higher values of the staging parameter (SP) according to the present invention.

A fifth influencing parameter takes account of the effect of compressor surge on the stability of combustion in the staged combustion chamber.

A description is here added as to the methods to be applied to ensure a rapid, safe and power loss-free transition between the two modes of operation of the staged combustion chamber. Apparently, a staging event, i.e. a change of the operating modes, should not significantly impair the operation of the engine itself, for example compressor surge by unstable combustion or reduced surge margin, thrust loss, flameout, damage to the turbine by overheating and the like. The following methods are proposed to ensure a rapid and safe transition between the modes of operation:

During rapid load changes, the stability and quality of combustion is ensured by momentary enrichment (fattening) of the fuel-air-mixture of the pilot zone, this enrichment being achieved by leaning the main stage and supplying the resultant excess of fuel to the pilot burners. Thus, the pilot zone will always operate within its stability range and serve as source of ignition for the fuel-air-mixture of the main stage. To this effect, an extended fuel splitting table will be applied according to the momentary acceleration or deceleration, respectively, in which the apportioning of the total fuel mass flow to the pilot burners and to the main burners is specified in dependence of the staging parameter (SP). As indicative parameters for this fuel splitting table or this family of characteristics, respectively, use is made of the time derivation of the high-pressure compressor speed (N2) and the time derivation of the combustion chamber entry pressure (P30). In addition, defined closure rate limiters are provided to preclude an excessive change of the fuel mass flow of the pilot burners and, in consequence, an excessive change of the fuel-air-ratio in the pilot zone.

In parallel with or in support of the above, a split value may be adjusted to suit transient states, this split value describing the apportioning of the fuel to the pilot burners and to the main burners (and therefore being retrievable from the said fuel splitting table) and being used to control the staging valve unit. As mentioned elsewhere in this Specification, a pollutant-optimized family of characteristics is used for the control of the staging valve unit in the quasi-stationary operating states of the engine, with the staging parameter, or one of the staging parameters, according to the present invention being used as indicative input for this family of characteristics. It is now additionally proposed to adjust the computed split value by a correction factor during transient operating states of the engine, with this correction factor being computed in dependence of the time change of the rotational speed, in particular of the shaft of the high-pressure system of the engine. This adjustment may be effected such that the commanded pilot fuel mass flow and, in consequence, the fuel-air-ratio in the pilot zone is increased momentarily, thereby avoiding flameout in the pilot zone of the combustion chamber. In this context, it is recommendable to keep the split value as computed by the above method within defined limits using high-win and low-win elements common for electronic control circuitry.

In order to ensure the stability of operation of the staged combustion chamber upon detection of a compressor surge of the gas turbine aero-engine, the following is provided for in a further advantageous development of the present invention: The known or existing engine control laws allow for detection of compressor surge by recording severely fluctuating values of the gas pressure (P30) at the combustion chamber entry and by subsequent comparison with a set limit. It is here proposed that, in a digital electronic control unit for the implementation of the fuel injection system according to the present invention, a flag is set to "1" by the output of this logic for the duration of the detected surge. This flag is then used to alter the switching line in the control laws—which are also implemented in the electronic control unit—for the duration of compressor surge (reference is here made to FIG. 5 detailed further below). For this purpose, the staging point is shifted into the area of high load points so that the staged combustion chamber remains in the operating mode present prior to occurrence of compressor surge. This precludes cyclic switching between the two operating modes of the combustion chamber in the case of a major change of the staging parameter (i.e. between the pilot mode, in which only the pilot burners are supplied with fuel, and the staged mode, in which fuel is also supplied to the main burners). Upon cessation of the surge event—i.e. when the flag re-assumes the value "0"—the value for the staging point will again be computed according to the (regular) control laws for the staged combustion chamber operation. Besides the avoidance of cyclic shifting, a further advantage of this method lies in the fact that the actual fuel split during short-term compressor surge, without a change of the operating mode taking place, is still computed from a family of characteristics. This ensures that the pilot fuel mass proportion is determined from the fuel-air-ratio and that a sufficient stability reserve against flameout is preserved.

In a preferential development of the present invention, recourse is made to a substitute limit value for the split value if the computed and subsequently time-differentiated split value exceeds a given differential limit value. This approach provides for accommodation of any disturbances occurring in the controlled variable, for example during very fast load changes or in the case of unexpected malfunction, in that a limitation is applied to the opening or closing rate of the staging valve unit. With regard to this, reference is here made to the enclosed FIG. 4 detailed briefly further below. In this connection, the time derivation of the computed split value is formed via a time step and limited by means of a limiter. This limiter is only active if the commanded or determined split value falls below a defined limit which takes account of the maximum permissible fuel split between the pilot burners and the main burners. A maximum permissible rate of change is applied to the current rate of change of the staging valve unit position while a pre-defined limit is reached.

It is further proposed to suppress any change as regards the extraction of engine bleed air during a staging event or a transition from the pilot mode (i.e. only the pilot burners are supplied with air) to the staged mode (i.e. both the pilot burners and the main burners are supplied with air). This will preclude additional variations of the fuel-air-mixture. After a maximum split value is subsequently undershot in the staged operating mode, the desired air bleed will take place with minimum delay in the staged operating mode.

Finally, it is advantageous to provide a staging anticipation logic which effects a momentary filling of the main burners with fuel if activation of the main burners is imminent. The provision of this feature is intended to avoid thrust losses and combustion chamber instabilities in the course of a staging event (i.e. if the main burners are to be supplied with fuel subsequently to the pilot burners operating alone until then). It must be understood that, in the case of such a transient engine maneuver, the process of filling up the dead volume of the main burner nozzles, while small, may result in a momentary decrease of the total fuel mass flow supplied to the combustion chamber. This effect can only be avoided by way of a staging anticipation logic which additionally increases the opening of a pressure control valve (metering valve of the total fuel mass flow) for a short term during the staging event, thereby maintaining the fuel pressure in the pilot burners and, consequently, the fuel flow through the pilot burners and filling up the dead volumes in the main burners more quickly. Both the period and the amount of the positional change of the valve are established in dependence of parameters which consider the stationary operating mode and the change of this operating mode. At the same time, this will cause the entire fuel-air-ratio in the combustion chamber to be enriched by a certain degree during the staging event, this enrichment being indispensable to compensate for the delay in the conversion of fuel into thermal energy resulting from the ignition lag. Besides that, other possibilities exist to provide an increased fuel mass flow if a staging event is imminent to completely fill the main burners and to avoid a momentary thrust loss which otherwise may occur.

As an inquiry condition for the function proposed above, use is made of any parameter which is related to the implemented basic formula or the basic control laws for the staging event, respectively, any combination of the parameters with each other, and the possibility to extend the inquiry condition by further tables based on this parameter. Basically, the said inquiry condition must merely be based on suitable tables which consider the loss or excess of the total fuel mass flow to be expected.

Figure 5:
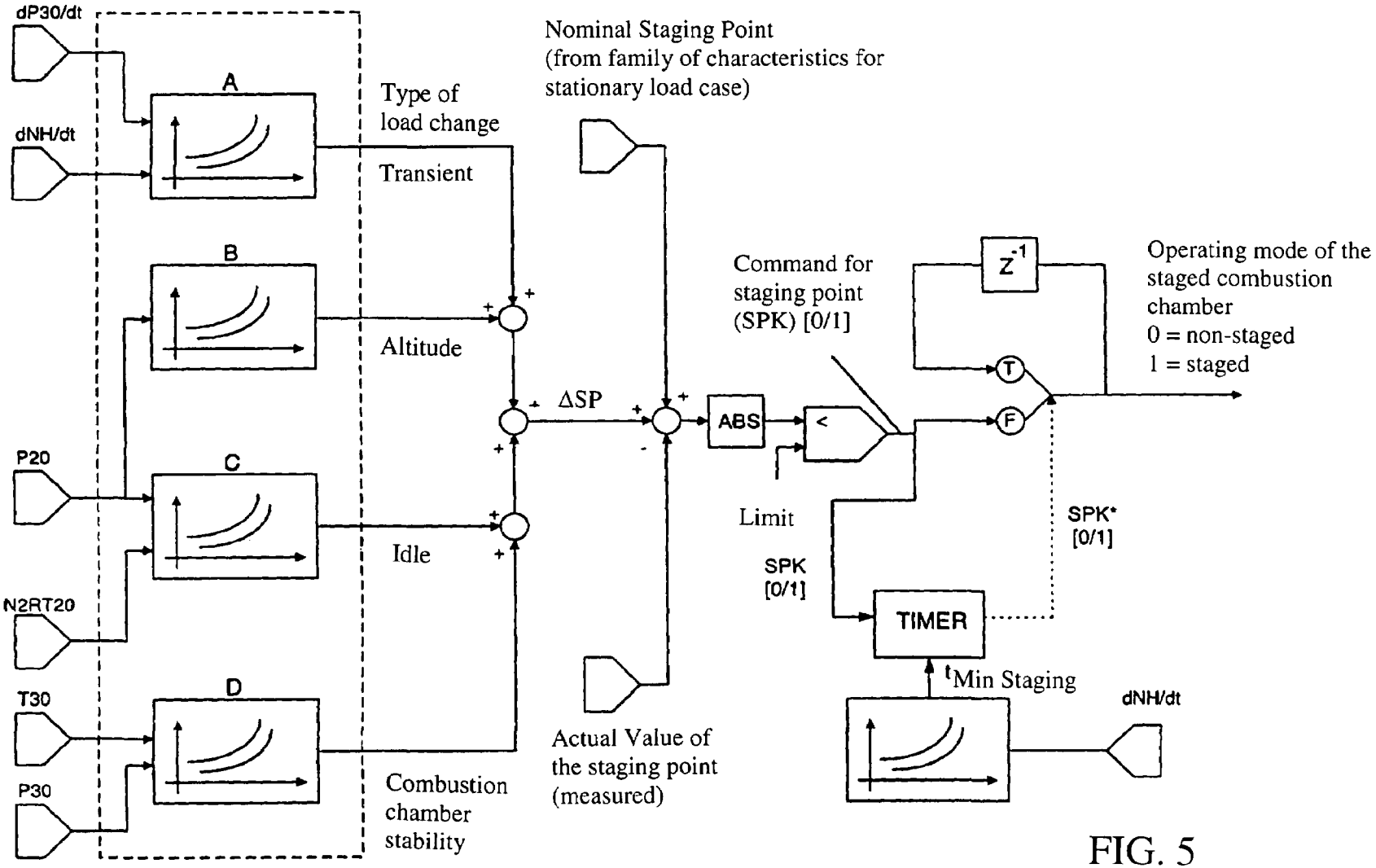

Accordingly, as illustrated in FIG. 5, the split value (S) specifies the actual value of apportionment of the fuel mass flows to the pilot stage or to the main stage of the combustion chamber, respectively. The staging point (SPK) indicates the current mode of the fuel injection system, i.e. it provides a condition indication. ABS in FIG. 5 designates an absolute value of the staging point, this absolute value being always positive. The downstream comparator, which also includes the limit, will then produce a SPK staging point value of 0 or 1.

FIG. 5 further illustrates that the time derivation of the high-pressure shaft rotational speed is included in the family of characteristics for the control of the TIMER. As detailed above in the specification, the selector element comprises two states, namely "T" for "true" and "F" for "false". In state "T", with the value SPk*=1, the historical value of BZ (operating state), i.e. the value from the last time step $Z^{-1}$, is used. In the legend in FIG. 5, SPK designates the command for the staging point, SPK* the time-delayed command for the staging point. State 0 designates a non-staged operating mode of the combustion chamber in which the pilot stage is switched on and the main stage is switched off. State 1 designates an operating mode in which both the pilot stage and the main stage are switched on.

In this context, reference is here made to a method for the priming of the fuel lines leading to the main burners which preferably may be applied during engine start. Usually, upon each shutdown of the engine, a fuel manifold which leads to the main burners is purged by way of a passive system, i.e. with air, with the fuel contained in the manifold being drained to a purge tank. During operation of the engine, it is however indispensable that the fuel manifold to the main burner nozzles be completely filled with fuel if transition from the non-staged pilot operation to the staged operation or operating mode is to be made. Compliance with this requirement is requisite for the safe and stable operation of the engine throughout its performance range. Therefore, a special measure must be provided to ensure that the fuel manifold to the main burners is filled parallel to the fuel manifold to the pilot burners during engine start. To accomplish this, the following method is proposed:

Prior to each start-up of the engine, the main burner fuel manifold is in a purged state. When the engine is started (this applies to both ground starts and in-flight starts), the entire fuel line volume between the fuel metering unit or control valve unit, respectively, and the injectors of the pilot burners and the main burners is first filled in the shortest possible time. Owing to the quickness of the filling process, the injection of fuel into the combustion chamber and, in consequence, the ignition lag occurring therein will be reduced to the least possible amount. In order to ensure that this requirement is met, an additional logic is implemented in the engine electronic control unit. Accordingly, all fuel manifolds are initially filled up by way of an increased fuel mass flow which is a multiple of the fuel mass flow required for ignition. To ensure that this fuel will actually reach the lines leading to the main burners, the said staging valve unit is temporarily set from the position in which only the pilot burners are supplied with fuel to a semi-open position in which fuel is also supplied to the main burners. In consequence, the fuel lines leading to the main burners are filled with fuel parallel to the pilot lines. The respective opening time and the opening position of the staging valve unit are here pre-defined suitably. The advantage of this method lies in the fact that any control of the filling state of the line in/to the main burners is dispensable.

To ensure that the main burner fuel lines are completely filled, the fuel pressure in these lines must, of course, be kept sufficiently high by appropriate positioning of the staging valve unit so that the non-return valves in the main burner injectors are cracked momentarily, the air cushion formed and a small quantity of fuel is forced into the combustion chamber. This small quantity of fuel will then be burnt in the combustion chamber together with the ignition fuel mass flow injected simultaneously through the pilot burners. The main burner injectors are again purged of fuel by the passive purging system, thereby preventing the main burners from coking. Subsequently, the staging valve unit is closed (i.e. only the pilot burners are switched in) and the fuel mass flow from the fuel metering unit or the control valve unit, respectively, reduced to the level of fuel mass flow required for ignition at the same time. Further control of the fuel supply until ignition and acceleration corresponds to that of an engine equipped with a conventional system.

Figure 2:
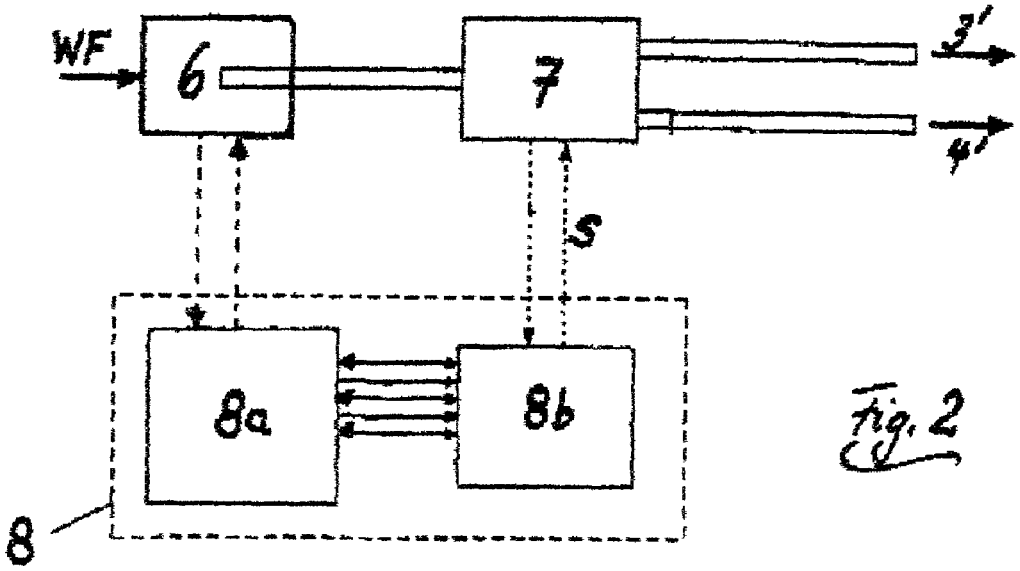
Figure 3:
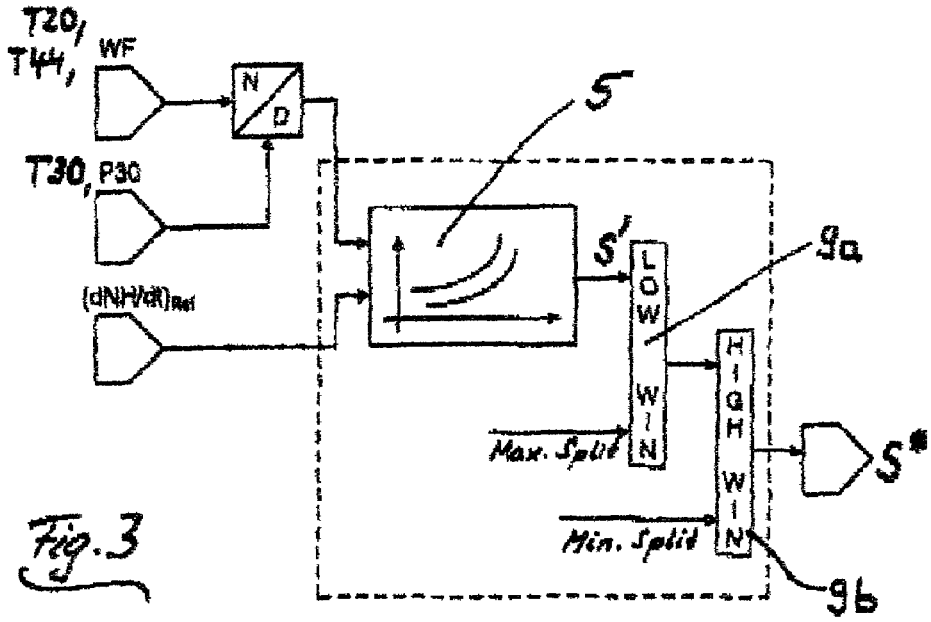
Figure 4:
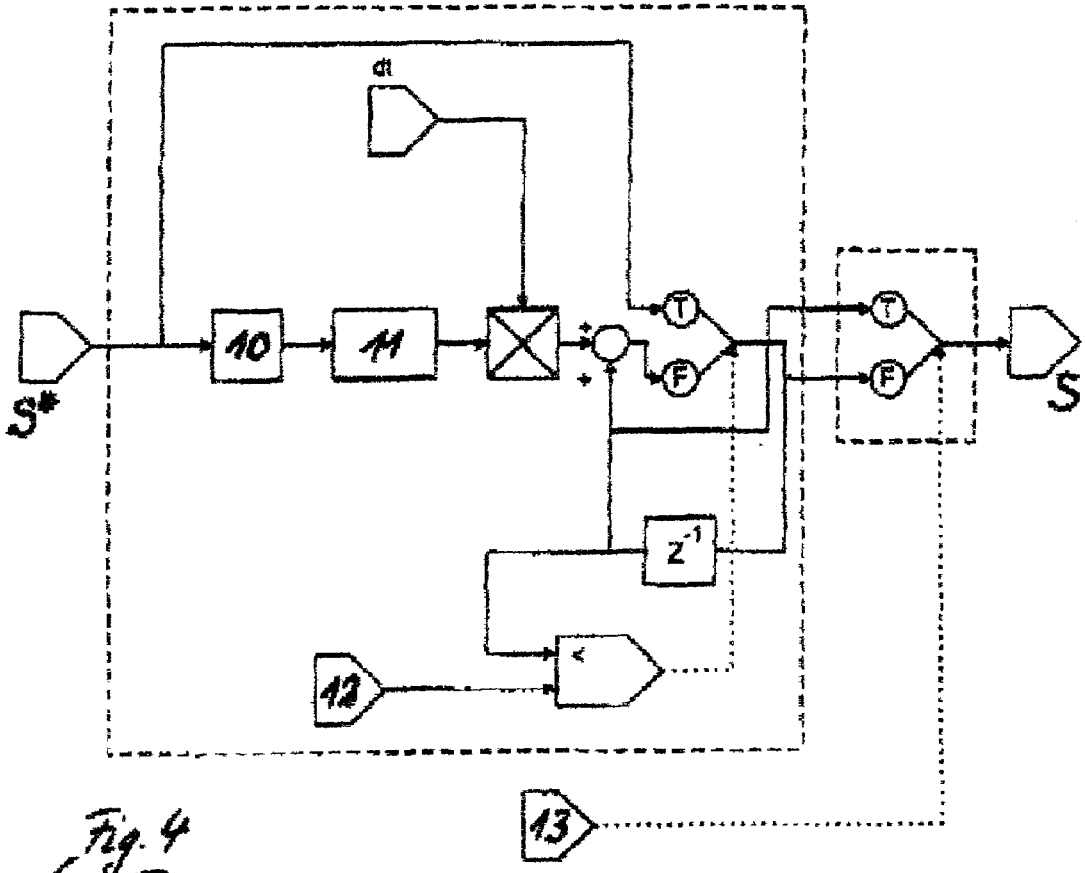

Further aspects and advantages of the present invention are described more fully in the light of the embodiments shown on the accompanying drawings, in which FIG. 1 is a schematic representation of a staged combustion chamber of a gas turbine aero-engine, FIG. 2 is a schematic partial view of an engine control unit according to the present invention, FIG. 3 is a partial block diagram of the engine control unit according to the present invention, FIG. 4 is a further partial block diagram of the engine control unit according to the present invention, and FIG. 5 is a block diagram for the implementation of a digital electronic control unit in a preferred embodiment of the fuel injection system according to the present invention.

In FIG. 1, which is a usual partial section of a staged annular combustion chamber of a gas turbine aero-engine, reference numeral 1 indicates the combustion chamber and reference numeral 2 the exit of this combustion chamber 1. An upstream compressor arrangement compresses a gas or air flow and supplies it, as indicated by the arrows, to the combustion chamber 1, said gas or air flow carrying the oxygen necessary for burning the fuel (shown dotted) which is fed to the combustion chamber 1 via the pilot burner 3 (or several, annularly arranged pilot burners 3) and, if applicable, via the main burner 4 (or several, annularly arranged main burners 4) in the interior of the combustion chamber 1. Subsequently, the combustion gases are discharged via the combustion chamber exit 2 to initially the turbine of the engine, as indicated by the arrowhead.

The combustion chamber 1 is sub-divided into a pilot zone 1*a*, which is located directly downstream of the pilot burners 3, and into a main zone 1*b*, which follows downstream in the direction of gas flow and into which the fuel is supplied by the main burners 4. However, the latter process, i.e. the supply of fuel into the main zone 1*b* of the combustion chamber 1 via the main burners 4 only takes place in such operating points of the engine in which a higher power development or power output is demanded. Conversely, fuel is permanently supplied to the combustion chamber 1 via the pilot burners 3. Accordingly, in dependence of the respective operating point of the gas turbine aero-engine, the pilot burners 3 will supply between 10% and 100% of the total fuel mass flow into the combustion chamber 1 and, complementarily, the main burners 4 will supply the combustion chamber 1 with 90% of the total fuel mass flow at very high engine performance and with 0% of the total fuel mass flow at low engine performance.

FIG. 2 is a schematic and, therefore, highly simplified representation of a fuel injection system for the supply of fuel to the pilot burners 3 and the main burners 4 according to the present invention. The arrow WF indicates the total fuel mass flow which is introduced into the combustion chamber 1 upon being apportioned by way of a control valve unit 6 to suit a certain operating point of the engine. A staging valve unit 7 is used to set the share of this total fuel mass flow WF which is to be supplied to the pilot burners 3 and which is indicated by the arrow 3' and the (complementary) share of this total mass flow WF which is to be supplied to main burners 4 and which is indicated by the arrow 4'.

Reference numeral 8 indicates the (electronic) engine control unit which usually comprises several control blocks. A first control block 8*a* is here shown which actuates, or suitably positions or sets, the control valve unit 6 and which includes or applies accordingly suitable (usual) engine control laws. Furthermore, a second control block 8*b* is shown which controls the staging valve unit 7 and which includes or applies accordingly suitable control laws for staged combustion. Thus, the control block 8*b* serves to determine the split value, which indicates the apportionment of the total fuel mass flow WF between the pilot burners 3 and the main burners 4, and to set the staging valve unit 7 correspondingly.

FIG. 3 shows, in a schematic and highly simplified form, the calculation of the apportionment of the total fuel mass flow WF between the pilot burners 3 (fuel flow 3' in FIG. 2) and the main burners 4 (fuel flow 4' in FIG. 2), this apportionment being described by the spilt value S. As detailed further above, the following known parameters are applied for this purpose:

WF=Total fuel mass flow

P30=Gas pressure at the combustion chamber entry

T30 Gas temperature at the combustion chamber entry, or

T44=Total temperature downstream of the engine high-pressure turbine, and, if applicable, T20=Gas temperature at the engine inlet According to the explanations in the above, these parameters are used to establish the staging parameter SP.

In addition, the time change of the rotational speed of the engine high-pressure system shaft, i.e. the quotient (dNH/

$dt)_{Ref}$, may be included, as explained further below in connection with Claim 3. By way of the family of characteristics 5, a split value S' will be established which will then be passed through an actually conventional low-win element 9*a* and a high-win element 9*b*, thereby providing a nominal split value S*. While the low-win element 9*a* takes account of a maximum split value MAX (corresponding to a 100% fuel share for the pilot burners 3), the high-win element 9*b* takes account of a minimal split value MIN for the pilot burners 3 which may range between 10% and 40% fuel share. In this context, reference is again made to the explanations made in connection with Claim 3.

FIG. 4 illustrates a preferred type of limitation of the fuel apportionment between the pilot burners 3 and the main burners 4. In this context, reference is made to the explanations provided in Claim 5. The reference numeral 10 indicates a (time) differentiation element for the nominal split value S*, the reference numeral 11 designates the limiter mentioned in connection with Claim 5 in the above passage of the specification. The limit, which may be included in said inquiry, is indicated by reference numeral 12 and, as an input, may amount to 50%, for example. In the case of a switch-over from the pilot mode to the dual mode (in which both the pilot burners and the main burners are operating), the commanded split value will pass the range between 100% and 40%. Only after the pilot fuel share has fallen below 50%, limitation of the fuel apportionment to the pilot burners will take effect. This means that the share 4' of the total fuel mass flow WF which is allowed to enter the combustion chamber 1 via the main burners 4 can range between 0% and 50%.

Finally, FIG. 5 is a schematic representation of the preferred method for the calculation of the operating mode of the combustion chamber 1, i.e. its operation either in the pilot mode or in the staged mode. The output in this schematic representation is a digital yes/no parameter which indicates whether or not the main burners 4 are supplied with fuel.

As can be seen and as already explained in detail, various additive correction elements ΔSP are included in said determination, or calculation, of the staging point accomplished with almost no loss of thrust. Advantageously, the staging event does not make use of the stability reserve of the compressor.

The infinitely adjustable staging valve unit 7 ensures that both the emission levels of the combustion chamber, in particular with regard to $NO_x$, and the temperature profile at the turbine inlet downstream of the combustion chamber 1 are optimized throughout the operating envelope of the engine. The selected method of adjustment of the fuel split, i.e. the split value S, to the pilot burners 3 and to the main burners 4 accordingly provides for flexible distribution of the fuel in accordance with the current demands on the control system in the respective operating mode. Besides the optimal adjustment of the fuel split with regard to the minimization of the pollutant emissions, this method accordingly also provides for optimization of the operating behavior of the combustion chamber as regards combustion stability, combustion efficiency characteristics and temperature exit profile throughout the load envelope of the engine.

As described, the major influencing factors on the staging point, such as altitude, transient maneuvers, as well as the correct adjustment of the fuel split between both circuits in the staged mode are preferably considered separately. All major influencing factors on the staging behavior are reflected in simple families of characteristics, with their effects on both the staging point and on the fuel split, i.e. the splitting value S, being considered additively. This provides for optimization of combustion in both combustion chamber zones, i.e. the pilot zone 1*a* and the main zone 1*b*, and for preservation of the stability of combustion.

Generally, the use of well measurable engine parameters, such as WF, P30, T30 and others, enhances the quality of control. This helps to preclude the synthesizing of engine parameters. Furthermore, a significant reduction of the engine performance during a staging event can be precluded by implementation of the staging anticipation logic. The inclusion of a starting event, as described herein, is another merit of the fuel injection system according to the present invention. Finally, the software for the control of the staging event is easily implementable into an existing engine control unit, and apparently a plurality of modifications other than those described may be made to the embodiment here shown without departing from the inventive concept.

Summarizing, then, the present invention relates to a fuel injection system for a staged combustion chamber 1 of a gas turbine aero-engine, in which a certain quantity of fuel is permanently supplied to the pilot burner(s) 3 and in which fuel is apportioned to the main burner(s) 4 only at higher engine performance, whereby a staging valve unit 7 which variably splits the total fuel mass flow (WF) between the pilot burners 3 and the main burners 4 is provided downstream of a control valve unit 6 which controls the entire fuel mass flow, with both valve units being actuated by an engine control unit 8 and with the actuation of the staging valve unit 7 being accomplished on the basis of the desired engine performance, characterized in that engine performance is described by a staging parameter (SP) which reflects the load of the gas turbine combustion chamber 1 and which actuates the staging control unit 7 according to a switching line, in that the staging parameter (SP) is derived from a functional relationship, in that a downstream summation point is provided for the computation of the difference between an actual value of the staging point and a value of the nominal staging point, and in that a time element (TIMER) is provided subsequent to the summation point, said time element being designed such that switch-over is delayed upon overshooting or undershooting of the adjusted staging point, respectively, if the period since the execution of the previous staging event is smaller than a pre-defined time constant held in a family of characteristics.

What is claimed is:

1. A fuel injection system for a staged combustion chamber of a gas turbine engine, comprising:

a control valve unit for variably adjusting a total fuel mass flow (WF) to pilot burners and main burners of the engine;

a staging valve unit provided downstream of the control valve unit for variably splitting the total mass fuel flow (WF) in a staged mode between the pilot burners and the main burners;

an engine control unit for controlling the control valve unit and the staging valve unit, the engine control unit controlling the staging valve unit to supply a certain quantity of fuel to the pilot burners under all operating conditions and to supply fuel to the main burners in the staged mode only at higher engine performance;

the engine control unit constructed and arranged to calculate a staging parameter (SP) reflecting a load of the combustion chamber based on at least one engine operating parameter and control the staging valve unit to variably split the total mass fuel flow (WF) in the staged mode between the pilot burners and the main burners based on the staging parameter (SP);

the engine control unit constructed and arranged to compute a difference between a nominal staging point and an actual staging point at a summation step to determine in which of the staged mode and a non-staged mode the engine should operate; and the engine control unit including a timer operating in response to a result from the summation step to delay change between the staged and non-staged mode if a period of time since a previous staging event is smaller than a predetermined time constant.

2. A fuel injection system as in claim 1, wherein the timer is constructed and arranged to actuate when the actual value of the staging point is 1.

3. A fuel injection system as in claim 1, wherein the engine control unit includes an operating characteristics-based control to control the timer.

4. A fuel injection system as in claim 3, wherein the operating characteristics-based control is constructed and arranged to output a control parameter $t_{MIN,staging}$ to the timer.

5. A fuel injection system as in claim 4, wherein the engine control unit is constructed and arranged to set the control parameter small for rapid load changes and large for slow load changes.

6. A fuel injection system as in claim 5, wherein the engine control unit is constructed and arranged to input a time derivation of a rotational speed of a high-pressure turbine shaft (dNH/dt) to the operating characteristics-based control.

7. A fuel injection system as in claim 6, wherein the engine control unit includes a mode selector element and is constructed and arranged to input an output value SPK* of the timer to the mode selector element.

8. A fuel injection system as in claim 7, wherein the mode selector element is constructed and arranged to select the actual value of the staging point computation when SPK*=0 and the value of a previous time step ($Z^{-1}$) when SPK*=1.

9. A fuel injection system as in claim 8, wherein the engine control unit is constructed and arranged to derive the staging parameter (SP) from at least one of the following functional relationships:

(Total fuel mass flow WF) divided by (gas pressure at combustion chamber entry P30) multiplied by (gas temperature at combustion chamber entry T30), [WF/P30·T30];

(Total fuel mass flow WF) divided by (gas pressure at combustion chamber entry P30) multiplied by (square root of the gas temperature at the combustion chamber entry T30), [WF/P30·(T30)$^{1/2}$];

(Total fuel mass WF) divided by (gas pressure at combustion chamber entry P30) multiplied by (square root of the quotient of the gas temperature at the combustion chamber entry T30 and the gas temperature at the engine inlet T20), [WF/P30·(T30/T20)$^{1/2}$];

(Total fuel mass flow WF) divided by (gas pressure at combustion chamber entry P30) multiplied by (total temperature T44 downstream of the high-pressure turbine), [WF/P30·T44]; and (Total fuel mass flow WF) divided by (gas pressure at combustion chamber entry P30) multiplied by (square root of total temperature T44 downstream of the high-pressure turbine), [WF/P30·(T44)$^{1/2}$].

10. A fuel injection system as in claim 9, wherein the engine control unit is constructed and arranged to control the main burners to switch on when an adjusted staging point reflecting engine performance rises above the actual staging point and to control the main burners to switch off when the adjusted staging point falls below the actual staging point, the engine control unit being constructed and arranged to derive the adjusted staging point by adding at least one correction element (ΔSP) to the nominal staging point, said correction element reflecting at least one of the following influencing parameters:

absolute value of the gas pressure at the combustion chamber entry (P30);

absolute value of the gas temperature at the combustion chamber entry (T30);

corrected speed of the high-pressure compressor (N2RT20) and gas pressure at the engine inlet (P20);

flight altitude;

selected ambient conditions;

rate of load change; and compressor surge.

11. A fuel injection system as in claim 10, whereby the engine control unit is constructed and arranged to determine a split value (S) from the staging parameter (SP), the split value describing the fuel apportionment between the pilot burners and the main burners and being used to control the staging valve unit, wherein the engine control unit is constructed and arranged to adjust the split value (S) for transient states of the engine with a correction factor established in dependence on the time derivation of the rotational speed of the high-pressure shaft of the engine.

12. A fuel injection system as in claim 11, wherein the engine control unit is constructed and arranged to substitute a limiting value for the split value if a time-differentiated value of the split value exceeds a limiting differential value.

13. A fuel injection system as in claim 12, wherein the engine control unit is constructed and arranged to preclude a change of an air blood rate of the engine during a staging event in which the main burners are switched between activation and de-activation.

14. A fuel injection system as in claim 13, wherein the engine control unit includes a staging anticipation logic to control the staging valve unit to short-term fill the main burners if their activation is imminent.

15. A fuel injection system as in claim 14, wherein the engine control unit is constructed and arranged to control the staging valve unit to fill fuel lines to the main burners and fuel lines to the pilot burners during start-up of the engine without measuring a filling state in the main burner filet lines.

16. A fuel injection system as in claim 1, wherein the engine control unit is constructed and arranged to derive the staging parameter (SP) from at least one of the following functional relationships;

(Total fuel mass flow WF) divided by (gas pressure at combustion chamber entry P30) multiplied by (gas temperature at combustion chamber entry T30), [WF/P30·T30];

(Total fuel mass flow WF) divided by (gas pressure at combustion chamber entry P30) multiplied by (square root of the gas temperature at the combustion chamber entry T30), [WF/P30·(T30)$^{1/2}$];

(Total fuel mass WF) divided by (gas pressure at combustion chamber entry P30) multiplied by (square root of the quotient of the gas temperature at the combustion chamber entry T30 and the gas temperature at the engine inlet T20), [WF/P30·(T30/T20)$^{1/2}$];

(Total fuel mass flow WF) divided by (gas pressure at combustion chamber entry P30) multiplied by (total temperature T44 downstream of the high-pressure turbine), [WF/P30·T44]; and (Total fuel mass flow WF) divided by (gas pressure at combustion chamber entry P30) multiplied by (square root of total temperature T44 downstream of the high-pressure turbine), $[WF/P30\cdot(T44)^{1/2}]$.

17. A fuel injection system as in claim 1, wherein the engine control unit is constructed and arranged to control the main burners to switch on when an adjusted staging point reflecting engine performance rises above the actual staging point and to control the main burners to switch off when tie adjusted staging point falls below the actual staging point, the engine control unit being constructed and arranged to derive the adjusted staging point by adding at least one correction element (ΔSP) to the nominal staging point, said correction element reflecting at least one of the following influencing parameters:

absolute value of the gas pressure at the combustion chamber entry (P30);

absolute value of the gas temperature at the combustion chamber entry (T30);

corrected speed of the high-pressure compressor (N2RT20) and gas pressure at the engine inlet (P20);

flight altitude;

selected ambient conditions;

rate of load change; and compressor surge.

18. A fuel injection system as in claim 1, whereby the engine control unit is constructed and arranged to determine a split value (S) from the staging parameter (SP), the split value describing the fuel apportionment between the pilot burners and the main burners and being used to control the staging valve unit, wherein the engine control unit is constructed and arranged to adjust the split value (S) for transient states of the engine with a correction factor established in dependence on the time derivation of the rotational speed of the high-pressure shaft of the engine.

19. A fuel injection system as in claim 1, wherein the engine control unit is constructed and arranged to preclude a change of an air bleed rate of the engine during a staging event in which the main burners are switched between activation and de-activation.

20. A fuel injection system as in claim 1, wherein the engine control unit includes a staging anticipation logic to control the staging valve unit to short-term fill the main burners if their activation is imminent.

21. A fuel injection system as in claim 1, wherein the engine control unit is constructed and arranged to control the staging valve unit to fill fuel lines to the main burners and fuel lines to the pilot burners during start-up of the engine without measuring a filling state in the main burner fuel lines.

* * * * *